United States Patent [19]

Oda et al.

[11] 4,134,847

[45] Jan. 16, 1979

[54] METHOD FOR THE PRODUCTION OF A COLOR DEVELOPER AND THE OBTAINED COLOR DEVELOPER

[75] Inventors: Shin-ichi Oda, Hyogo; Tosaku Okamoto; Akira Nakanishi, both of Osaka; Takio Kuroda, Hyogo, all of Japan

[73] Assignees: Kanzaki Paper Manufacturing Co., Ltd., Tokyo; Sanko Kagaku Co., Ltd., Fukuoka, both of Japan

[21] Appl. No.: 801,425

[22] Filed: May 27, 1977

[30] Foreign Application Priority Data

May 29, 1976 [JP] Japan ..... 51-62790

[51] Int. Cl.[2] ..... G03G 9/00

[52] U.S. Cl. ..... 252/62.1 P; 252/62.1 R; 260/42.55; 427/150; 428/307

[58] Field of Search ..... 106/21; 260/42.54, 42.55, 260/42.44; 428/307, 914; 252/62.1 P

[56] References Cited

U.S. PATENT DOCUMENTS

| | | | |
|---|---|---|---|
| 3,955,025 | 5/1976 | Matsukawa et al. | 428/307 X |
| 3,955,026 | 5/1976 | Matsukawa et al. | 428/307 X |
| 4,021,595 | 5/1977 | Kiritani et al. | 428/307 |

*Primary Examiner*—Leland A. Sebastian

*Attorney, Agent, or Firm*—Morgan, Finnegan, Pine, Foley & Lee

[57] ABSTRACT

A color developer is obtained by the process which comprises heating a mixture of at least one aromatic carboxylic acid, at least one water-insoluble organic polymer and at least one oxide or carbonate of polyvalent metal to melt at least one of aromatic carboxylic acid and said polymer to form a homogeneous mass. The color developer may be pulverized to form finely divided particles.

40 Claims, No Drawings

METHOD FOR THE PRODUCTION OF A COLOR DEVELOPER AND THE OBTAINED COLOR DEVELOPER

BACKGROUND OF THE INVENTION

This invention relates to a method for the production of a color developer and the product. Particularly, this invention relates to a new method for the production of a color developer useful in producing a copying sheet such as pressure-sensitive copying sheet and heat-sensitive copying sheet.

Several types of copying systems are known utilizing electron donor-acceptor color forming reaction between an electron donating colorless chromogenic material (hereinafter referred to as "color former") and an electron accepting acidic reactant material (hereinafter referred to as "color developer"). For example, the most typical pressure-sensitive copying systems are disclosed in U.S. Pat. Nos. 2,730,456, 2,730,457 and 3,672,935 and the heat-sensitive copying systems are disclosed in Japanese Pat. Publication Nos. 4160 of 1968 and 14039 of 1970 and British Pat. No. 1,056,365. Various forms of copying sheet are proposed and utilized.

As a color developer reacting with a color former such as triphenylmethane derivatives, fluoran derivatives and thiazine derivatives to form a colored image, there are known inorganic materials such as acid clay, bentonite, attapulgite, kaolin, fuller's earth and zeolite; physically or chemically treated inorganic materials such as activated clay, calcined kaolin and calcined activated clay; organic acid such as phenolic compounds, aromatic calboxylic acids for example benzoic acid, naphthoic acid and salicylic acid, and aromatic carboxylic acid derivatives; metallic compound of organic acids; mixture of organic acids and metal compounds such as zinc oxide and calcium carbonate; phenol-formaldehyde resin; salicylic acid-formaldehyde condensation product; styrene-maleic anhydride copolymer and metallic compound of the described above resinous materials. Generally, acids, acidic compounds toward color former on the theory of acid and base and materials oxidizing color former have been used as a color developer.

This invention relates to a method for the production of an improved color developer made from aromatic carboxylic acid as an essential component.

U.S. Pat. Nos. 2,900,388, 2,972,547 and 2,981,738 disclose the usage of salicylic acid, phenol, benzoic acid and the like as a color developer. Recording sheet applied with a particulate mixture comprising an organic carboxylic acid and/or polyvalent metal salt thereof and an organic high molecular compound compatible with them is disclosed in U.S. Pat. No. 3,924,027 by the inventors in this application.

An object of this invention is to provide a useful color developer essentially made from aromatic carboxylic acid, water-insoluble organic polymer and metal compound.

Another object of this invention is to provide a new method for the production of a color developer superior in color formability with activation of aromatic carboxylic acid.

Other objects and advantages of the invention will be apparent from the following description.

SUMMARY OF THE INVENTION

The color developer according to the invention is obtained by the process which comprises heating a mixture of at least one aromatic carboxylic acid, at least one water-insoluble organic polymer and at least one oxide or carbonate of polyvalent metal in the presence of water to melt at least one of aromatic carboxylic acid and said polymer and to make the mixture into a homogeneous mass.

The mass may be pulverized to form finely divided particles.

DETAILED DESCRIPTION OF THE INVENTION

The organic carboxylic acid useful in the invention is represented by the following formula I except for the compounds having a heteroaromatic ring.

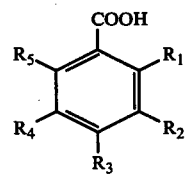

(I)

wherein $R_1$, $R_2$, $R_3$, $R_4$ and $R_5$ each represents hydrogen, halogen or a hydroxyl, amino, carboxyl, carbamoyl, N-substituted carbamoyl, alkyl, cycloalkyl, alkoxyl, aryl, aryloxy, aralkyl or alkylaryl group, and any adjacent pair of $R_1$ to $R_5$ can complete a ring such as naphthalene ring. Compounds of formula I wherein $R_1$ or $R_5$ is a hydroxyl group are especially important in embodiments of the invention as mentioned in detail hereinafter.

Examples of aromatic carboxylic acids of formula I wherein $R_1$ and $R_5$ are not a hydroxyl group include benzoic acid, o-toluic acid, m-toluic acid, p-toluic acid, p-tert-butylbenzoic acid, o-chlorobenzoic acid, m-chlorobenzoic acid, p-chlorobenzoic acid, dichlorobenzoic acid, trichlorobenzoic acid, phthalic acid, isophthalic acid, terephthalic acid, p-oxybenzoic acid, p-butoxybenzoic acid, p-octoxybenzoic acid, gallic acid, anthranilic acid, phthalic acid monoamide, phthalic acid monoanilide, 3-tert-butyl-4-hydroxybenzoic acid, 3-cyclohexyl-4-hydroxybenzoic acid, 3-phenyl-4-hydroxybenzoic acid, 3-(α-methylbenzyl)-4-hydroxybenzoic acid, 3,5-dimethyl-4-hydroxybenzoic acid, trimellitic acid, pyromellitic acid, α-naphthoic acid, β-naphthoic acid, tetrachlorophthalic acid, 2-carboxybiphenyl and 2,2'-dicarboxydiphenyl.

Aromatic carboxylic acids of formula I wherein $R_1$ or $R_5$ is a hydroxyl group are defined by formual II,

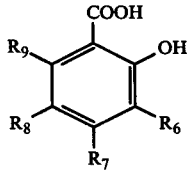

(II)

wherein $R_6$ to $R_9$ are as defined in $R_1$ to $R_5$ of formula I.

Examples of such carboxylic acids include salicylic acid, o-cresotinic acid, p-cresotinic acid, 3-ethylsalicylic acid, 4-ethylsalicylic acid, 3-isopropylsalicylic acid, 4-isopropylsalicylic acid, 5-isopropylsalicylic acid, 3-tert-butylsalicylic acid, 5-tert-butylsalicylic acid, 3-cyclohexylsalicylic acid, 5-cyclohexylsalicylic acid, 3-phenylsalicylic acid, 5-phenylsalicylic acid, 3-benzylsalicylic acid, 5-tert-octylsalicylic acid, 3-(α-methylbenzyl) salicylic acid, 5-(α-methylbenzyl) salicylic acid, 5-nonylsalicylic acid, 5-(α,α-dimethylbenzyl) salicylic acid, 5-chlorosalicylic acid, 5-butoxysalicylic acid and 5-octoxysalicylic acid.

Compounds of formula II wherein $R_6$ and $R_8$ are halogen, alkyl, cycloalkyl, aryl, aralkyl or alkylaryl can be easily derived in commercial scales from phenols, alkylphenols, arylphenols or halogenated phenols. Examples of such aromatic carboxylic acids, include 3,5-dichlorosalicylic acid, 3-chloro-5-tert-butylsalicylic acid, 3-chloro-5-tert-amylsalicylic acid, 3-chloro-5-tert-octylsalicylic acid, 3-chloro-5-(α,α-dimethylbenzyl) salicylic acid, 3,5-dimethylsalicylic acid, 3-methyl-5-tert-butylsalicylic acid, 3-methyl-5-cyclohexylsalicylic acid, 3-methyl-5-tert-octylsalicylic acid, 3-methyl-5-(α-methyl-benzyl) salicylic acid, 3-methyl-5-nonyl-salicylic acid, 3-methyl-5-(α,α-dimethylbenzyl) salicylic acid, 3,5-diisopropylsalicylic acid, 3,5-sec-butylsalicylic acid, 3-tert-butyl-5-chlorosalicylic acid, 3-tert-butyl-5-methylsalicylic acid, 3-tert-butyl-5-ethylsalicylic acid, 3,5-di-tert-butylsalicylic acid, 3-tert-butyl-5-cyclohexylsalicylic acid, 3-tert-butyl-5-phenylsalicylic acid, 3-tert-butyl-5-(4'-tert-butylphenyl) salicylic acid, 3-tert-amyl-5-chlorosalicylic acid, 3-tert-amyl-5-methylsalicylic acid, 3-tert-amyl-5-ethylsalicylic acid, 3,5-di-tert-amylsalicylic acid, 3-tert-amyl-5-cyclohexylsalicylic acid, 3-tert-amyl-5-phenylsalicylic acid, 3-tert-amyl-5-(4'-tert-amylphenyl) salicylic acid, 3-cyclohexyl-5-chlorosalicylic acid, 3-cyclohexyl-5-methylsalicylic acid, 3-cyclohexyl-5-ethylsalicylic acid, 3,5-dicyclohexylsalicylic acid, 3-cyclohexyl-5-phenylsalicylic acid, 3-cyclohexyl-5-(4'-cyclohexylphenyl) salicylic acid, 3-phenyl-5-chlorosalicylic acid, 3-phenyl-5-isopropylsalicylic acid, 3-phenyl-5-tert-butylsalicylic acid, 3-phenyl-5-cyclohexylsalicylic acid, 3-phenyl-5-benzylsalicylic acid, 3-phenyl-5-tert-octylsalicylic acid, 3-phenyl-5-(α-methylbenzyl) salicylic acid, 3-phenyl-5-nonylsalicylic acid, 3-phenyl-5-(α,α-dimethylbenzyl) salicylic acid, 3-benzyl-5-chlorosalicylic acid, 3-benzyl-5-methylsalicylic acid, 3-benzyl-5-ethylsalicylic acid, 3-benzyl-5-cyclohexylsalicylic acid, 3-benzyl-5-phenylsalicylic acid, 3,5-dibenzylsalicylic acid, 3-benzyl-5-tert-octylsalicylic acid, 3-benzyl-5-nonylsalicylic acid, 3-benzyl-5-(α,α-dimethylbenzyl) salicylic acid, 3-tert-octyl-5-chlorosalicylic acid, 3-tert-octyl-5-methylsalicylic acid, 3-tert-octyl-5-ethylsalicylic acid, 3-tert-octyl-5-cyclohexylsalicylic acid, 3-tert-octyl-5-phenylsalicylic acid, 3,5-di-tert-octylsalicylic acid, 3-(α-methylbenzyl)-5-chlorosalicylic acid, 3-(α-methylbenzyl)-5-methylsalicylic acid, 3-(α-methylbenzyl)-5-ethylsalicylic acid, 3-(α-methylbenzyl)-5-cyclohexylsalicylic acid, 3-(α-methylbenzyl)-5-phenylsalicylic acid, 3,5-di(α-methylbenzyl) salicylic acid, 3-(α-methylbenzyl)-5-(α,α-dimethylbenzyl) salicylic acid, 3-(α-methylbenzyl)-5-{4'-(α-methylbenzyl)phenyl} salicylic acid, 3-nonyl-5-chlorosalicylic acid, 3-nonyl-5-methylsalicylic acid, 3-nonyl-5-ethylsalicylic acid, 3-nonyl-5-phenylsalicylic acid, 3,5-dinonylsalicylic acid, 3-(α,α-dimethylbenzyl)-5-chlorosalicylic acid, 3-(α,α-dimethylbenzyl)-5-methylsalicylic acid, 3-(α,α-dimethylbenzyl)-5-ethylsalicylic acid, 3-(α,α-dimethylbenzyl)-5-t-amylsalicylic acid, 3-(α,α-dimethylbenzyl)-5-cyclohexylsalicylic acid, 3-(α,α-dimethylbenzyl)-5-phenylsalicylic acid, 3-(α,α-dimethylbenzyl)-5-(α-methylbenzyl) salicylic acid, 3,5-di(α,α-dimethylbenzyl) salicylic acid, 3-(4'-tert-butylphenyl)-5-tert-butylsalicylic acid, 3-(4'-cyclohexylphenyl)-5-cyclohexylsalicylic acid and 3-{4'-(α,α-dimethylbenzyl) phenyl}-5-(α,α-dimethylbenzyl) salicylic acid.

Aromatic carboxylic acids of formula II in which $R_7$ or $R_9$ is alkyl or phenyl can be derived from, for example, metacresol, metapropylphenol, metaphenylphenol, 2,3-xylenol, 2,5-xylenol, 3,4-xylenol and 3,5-xylenol. Examples of such carboxylic acids include 3,4-dimethylsalicylic acid, 4,5-dimethylsalicylic acid, 4,6-dimethylsalicylic acid, 4-methyl-5-isopropylsalicylic acid, 4-methyl-5-sec-butylsalicylic acid, 4-methyl-5-tert-butylsalicylic acid, 4-methyl-5-tert-amylsalicylic acid, 4-methyl-5-cyclohexylsalicylic acid, 4-methyl-5-benzylsalicylic acid, 4-methyl-5-tert-octylsalicylic acid, 4-methyl-5-(α-methylbenzyl) salicylic acid, 4-methyl-5-nonylsalicylic acid, 4-methyl-5-(α,α-dimethylbenzyl) salicylic acid, 3,6-dimethylsalicylic acid, 3-tert-butyl-6-methylsalicylic acid, 3-tert-amyl-6-methylsalicylic acid, 3-cyclohexyl-6-methylsalicylic acid, 3-tert-octyl-6-methylsalicylic acid, 3-(α-methylbenzyl)6-methylsalicylic acid, 3,6-diisopropylsalicylic acid, 3-tert-butyl-6-isopropylsalicylic acid, 3-tert-octyl-6-isopropylsalicylic acid, 3-(α,α-dimethylbenzyl)-6-isopropylsalicylic acid, 3-tert-butyl-6-phenylsalicylic acid, 3-tert-amyl-6-phenylsalicylic acid, 3-cyclohexyl-6-phenylsalicylic acid, 3-tert-octyl-6-phenylsalicylic acid, 3-(α-methylbenzyl)-6-phenylsalicylic acid or 3-(α,α-dimethylbenzyl)-6-phenylsalicylic acid.

As the case that any adjacent pair of $R_6$ to $R_9$ in the general formula II form a ring, there are naphthalene derivatives. They are represented by formulae III, IV and V,

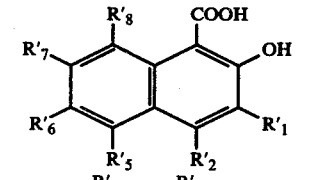

(III)

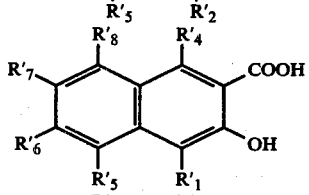

(IV)

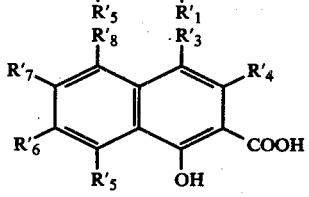

(V)

wherein $R'_1$, $R'_2$, $R'_3$, $R'_4$, $R'_5$, $R'_6$, $R'_7$ and $R'_8$ each is hydrogen, halogen or a hydroxyl, alkyl, cycloalkyl or aralkyl group. As examples of such napthalene derivatives, there are indicated 1-hydroxy-2-carboxynaphthalene, 1-hydroxy-2-carboxy-4-isopropylnaphthalene, 1-hydroxy-2-carboxy-4-cyclohexylnaphthalene, 1-hydroxy-2-carboxy-4-benzylnaphthalene, 1-hydroxy-2-carboxy-4-(α-methylbenzyl) naphthalene, 1-hydroxy-2-carboxy-7-isopropylnaphthalene, 1-hydroxy-2-carboxy-7-tert-butylnaphthalene, 1-hydroxy-2-carboxy-7-tert-amylnaphthalene, 1-hydroxy-2-carboxy-7-cyclohexylnaphthalene, 1-hydroxy-2-carboxy-7-tert-octylnaphthalene, 1-hydroxy-2-carboxy-7-(α-methylbenzyl) naphthalene, 1-hydroxy-2-carboxy-7-(α,α-dimethylbenzyl) naphthalene, 1-hydroxy-2-carboxy-4,7-diisopropylnaphthalene, 1-hydroxy-2-carboxy-4,7-di-tert-butylnaphthalene, 1-hydroxy-2-carboxy-4,7-di-tert-amylnaphthalene, 1-hydroxy-2-carboxy-4,7-dicyclohexylnaphthalene, 1-hydroxy-2-carboxy-4,7-di-benzylnaphthalene, 1-hydroxy--di(α-methylbenzyl) naphthalene, 1-hydroxy-2-carboxy-4,7-di(α,α-dimethylbenzyl) napthalene, 1-carboxy-2-hydroxy napthalene, 1-carboxy-2-hydroxy-3,6,8-tri-tert-butylnaphthalene, 2-hydroxy-3-carboxynaphthalene, 2-hydroxy-3-carboxy-6,8-di-tert-buthylnaphthalene, 2-hydroxy-3-carboxy-6,8-di-tert-amylnaphthalene, 2-hydroxy-3-carboxy-6,8-dicyclohexylnaphthalene, 2-hydroxy-3-carboxy-6,8-di-tert-octylnaphthalene, 2-hydroxy-3-carboxy-6,8-di(α-methylbenzyl) naphthalene or 2-hydroxy-3-carboxy-6,8-di(α,α-dimethylbenzyl) naphthalene.

Aromatic carboxylic acids derived from, for example, bisphenol A, 4,4'-dihydroxycyclohexylidenebiphenyl, 4,4'-dihydroxymethylenebiphenyl and 2,2'-dihydroxydiphenyloxide are regarded as condensates of salicyclic acid. Examples of these carboxylic acids include 5-(4'-hydroxybenzyl) salicylic acid, 5-(3'-carboxy-4'-hydroxybenzyl) salicylic acid (methylene-bissalicylic acid), 3-tert-butyl-5-(3',5'-di-tert-butyl-4-hydroxybenzyl) salicylic acid, 3-(α,α-dimethylbenzyl)-5-{3',5'-di(α,α-dimethylbenzyl)-4'-hydroxybenzyl}salicylic acid, 3-tert-butyl-5-(α,α-dimethyl-3',5'-di-tert-butyl-4'-hydroxybenzyl) salicylic acid, 5-(α,α-dimethyl-3'-carboxy-4'-hydroxybenzyl) salicylic acid, 5-(α,α-dimethyl-4'-hydroxybenzyl) salicylic acid, 3-(2'-hydroxyphenoxy)salicylic acid, 3-(2'-hydroxy-3'-carboxyphenoxy) salicylic acid, 3-(2'-hydroxy-3'-carboxy-5'-tert-butylphenoxy)-5-tert-butylsalicylic acid, 3-(2'-hydroxy-3',5'-di-tert-butylphenoxy-5-tert-butylsalicylic acid, 3-{2'-hydroxy-3'-carboxy-5'-(α,α-dimethylbenzyl) phenoxy}-5-(α,α-dimethylbenzyl) salicylic acid, 3-{2'-hydroxy-3',5'-di(α,α-dimethylbenzyl) phenoxy}-5-(α,α-dimethylbenzyl) salicylic acid or 3-(2'-hydroxy-3',5'-dicyclohexylphenoxy)-5-cyclohexylsalicylic acid.

Furthermore, a large number of aromatic carboxylic acids of general formula II which are difficult to be expressed in the chemical nomenclature are listed. For instance, there are indicated condensation products of formaldehyde with salicylic acid or nucleus-substituted salicylic acids and phenols, salicylic acid or nucleus-substituted salicylic acid adducts of propylene polymer or isobutylene polymer, salicylic acid or nucleus-substituted salicylic acid adducts of benzylchloride polycondensation products, salicylic acid or nucleus-substituted salicylic acid adducts of styrene polymers, salicylic acid or nucleus-substituted salicylic acid adducts of α-methylstyrene polymers, salicylic acid or nucleus-substituted salicylic acid condensates of aldehydes or acetylene, salicylic acid or nucleus-salicylic acid condensate of ketones, and salicylic acid or nucleus-substituted salicylic acid adducts of compounds having an unsaturated bond.

The term of "aromatic carboxylic acids" used herein and in the claims includes also the condensates and polymerides as mentioned above.

Among the above-mentioned aromatic carboxylic acids, compounds having at least one hydroxyl group on the benzene ring, particularly a hydroxyl group at the ortho-position to the carboxyl group are preferred from the point of view of color forming ability. From the compatibility with a water-insoluble organic polymer and the heat and moisture resistances of colored image obtained with the color developer, an aromatic carboxylic acid having a higher molecular weight is preferred, that is, ones having 10 or more, preferably 17 or more carbon atoms in total are recommended. Particularly, compounds of formula II, in which 3 position and/or 5 position to the carboxyl group is substituted with the group having 3 or more carbon atoms such as isopropyl, secondary butyl tertiary butyl, tertiary amyl cyclohexyl, phenyl substituted phenyl, benzyl, α-methylbenzyl, α,α-dimethylbenzyl tertiary octyl and nonyl, show excellent color-forming properties, and good compatibility with a water insoluble organic polymer. The color developer prepared with such compounds produces colored image superior in water resistance. Compounds of formulae II, III, IV and V bearing at least one of 5-membered and 6-membered carbon-rings as substituents and having 17 or more carbon atoms in total are most preferred.

A water-insoluble organic polymer mixed with an aromatic carboxylic acid in the invention should show an easily non-fluidifying property at normal temperature and preferably is selected from ones having a molecular weight of about 400 or more. Among the useful water-insoluble organic polymers, there are included such as polycyclopentadiene, cyclopentadiene copolymer, polystyrene, styrene copolymer poly(α-methylstyrene), α-methylstyrene copolymer, polyvinylchloride, vinylchloride copolymer, vinylidenechloride copolymer, polychloroprene, polyacrylic ester, acrylic ester copolymer acrylic acid copolymer, polymethacrylic ester, methacrylic ester copolymer, methacrylic acid copolymer, polyvinylacetate, vinylacetate copolymer, acrylonitrile copolymer, acrylamide copolymer, allylalcohol copolymer, benzylchloride polycondensation product, benzylchloride copolycondensation product, metaxylene-formaldehyde condensate, diphenyl-formaldehyde condensate, diphenyl-metaxylene-formaldehyde copolycondensation product and polycondensation product of phenols with aldehydes. Polystyrene, styrene copolymer, poly(α-methylstyrene) and α-methylstyrene copolymer are preferred. It is desirable for the above mentioned water-insoluble organic polymer to be selected from the compounds having compatibility with the aromatic carboxylic acid to be incorporated therein.

Among the metal compound mixed with aromatic carboxylic acid and water-insoluble organic polymer according to the invention, there are water-insoluble oxides and carbonates of polyvalent metal such as zinc, magnesium, aluminum, calcium, iron cobalt, nickel, manganese, copper, titanium, chromium, tin, barium, lead and cadmium. Oxides and carbonates of zinc, magnesium, aluminum and calcium are preferred. One or more of such metal compounds may be used. It is particularly preferred that the above mentioned preferable metal compound is used jointly with a metal compound selected from oxides and carbonates of nickel, cobalt and iron, because of increasing the stability of colored image.

The mixing ratio of water-insoluble polymer and metal compound to aromatic carboxylic acid may be selected freely according to the usage and not limited. However, the color developer prepared with too small amount of water-insoluble organic polymer is not preferable in the water or high moisture resistance and a coating composition comprising an aqueous dispersion of such color developer is not good in mechanical stability. The water-insoluble organic polymer may be suitably mixed with aromatic carboxylic acid in the weight ratio within the range of 0.05:1 to 5:1 on dry basis, more preferably within the range of 0.1:1 to 3:1. The color developer prepared with too small amount of metal compound also has not desirable feature. Metal compound may be suitably mixed with aromatic carboxylic acid in the weight ratio within the range of 0.01:1 to 50:1 on dry basis, more preferably within the range of 0.05:1 to 30:1.

In the invention at least one aromatic carboxylic acid, at least one water-insoluble organic polymer and at least one metal compound are heated in the presence of water to melt at least one of aromatic carboxylic acid and said organic polymer and to form a homogeneous mass. In order to activate the aromatic carboxylic acid and obtain the desirable effect according to the invention, the heating is carried out in the presence of 4% by weight or more of water on the total dry basis of aromatic carboxylic acid, water-insoluble organic polymer and metal compound. More preferably, the heating is carried out in the presence of 5 to 40% by weight of water on the total dry basis. A large amount of water remaining in the product or color developer tends to destroy the uniformity of the product and to make the property of its inequality. It is preferred to adjust the water content of the product to less than 2.5% by weight on the total dry basis, preferably less than 2.0% by weight on the total dry basis.

In order to satisfy the above mentioned condition, the heating temperature is preferably 90° C. or more. However the heating at too high temperature results in a contrary effect such as thermal decomposition of aromatic carboxylic acid or removing carbonic acid and OH group from aromatic carboxylic acid. The upper limit of the heating temperature is different depending upon the kind of the used aromatic carboxylic acid. From the various experimental results it is found that heating at more than 250° C. is attended with a contrary effect. It is preferred to heat at 250° C. or less, more preferably at 190° C. or less. From the object of heat treatment in the invention, it is undesirable to use an aromatic carboxylic acid which is sublimed at the boiling point of water or steam distilled, such as benzoic acid, salycylic acid and naphthoic acid.

The time of heating depends on the heating temperature and the heating device, it is particularly not limited. However, it is important to mix or blend uniformly the mixture and heat uniformly the whole mixture. The treating device may be selected from the known mixers and blenders with heating means such as kneader, extruder, Nauta mixer and roll mill; the device of the combination of the above mentioned mixer or blender with a dryer such as spray dryer; and the device disclosed in Perry and Chilton "CHEMICAL ENGINEER'S HANDBOOK" 5th edition and "PLASTIC KAKO GIJUTSU BINRAN OF 1963" (published by Nikkan Kogyo Shinbunsha)

At the time when aromatic carboxylic acid, water-insoluble organic polymer and metal compound are heated in the presence of water according to the invention, there may be used with water an organic solvent soluble in water such as methyl alcohol, ethyl alcohol, propyl alcohol, isopropyl alcohol and acetone or an organic solvent having a lower boiling temperature than that of water such as benzene, if necessary.

Further a water-soluble polymer employed as stabilizer for aqueous coating composition or binder such as polyvinyl alcohol, starch, polyvinyl alcohol derivatives, modified starch and cellulose derivatives may be added to the mixture at the heating process. The addition of the above water-soluble polymer improves the adhesion force and fluidity of the coating composition containing the color developer in an aqueous system.

The mixture may be heated with an inorganic pigment such as kaolin, activated clay, bentonite, china clay, zeolite, zinc silicate, barium sulfate and aluminum hydroxide in addition to metal compound. By the addition of the inorganic pigment, oil absorption of the obtained color developer is increased and the stability of colored image is improved and the pulverizing the color developer is easily achieved. Further, in addition to metal compound and/or inorganic pigment, there may be added general dispersing agent, wetting agent or surface-active agent such as benzenesulfonate, naphthalenesulfonate, polycondensate of benzenesulfonate or naphthalene sulfonate, polyacrylate and phosphate to improve the fluidity of the coating composition. The addition of ultraviolet absorbing agent or antioxidant at heating improves stability of colored images.

The amount of such adding agent may be selected according to the usage within the range of maintaining the characteristic of aromatic carboxylic acid. Generally, it is preferred to use water-soluble polymer, dispersing agent, wetting agent and surface-active agent in the amount of 0.01% to 10% by weight on the total dry basis of the heating mixture. In organic pigment is added preferably in the amount of 0.01 parts to 50 parts by weight on dry basis with respect to one part of aromatic carboxylic acid.

Usually, the color developer according to the invention is preferably used in an aqueous system, but it may be used in an organic solvent.

When the color developer according to the invention is used in the form of coating composition, the obtained color developer may be pulverized with a general grinder if necessary. In order to the further finely divided particles, the color developer may be pulverized with sand mill, ball mill, attritor, roll mill or coloid mill to form activated fine particles.

The color developer according to the invention may be applied solely, but may be added with an additive such as various metal compounds, inorganic pigment and the like on preparing a coating composition to improve the appearance of the obtained color developer sheet and the printability.

As additives used in the preparation of coating composition, there may be included the materials used in the preparation of general art paper, coated paper, pressure-sensitive copying paper and heat-sensitive copying paper such as dispersing agent, stabilizer, defoaming agent, wetting agent, various surface agent, ultraviolet absorbing agent, antioxidant, fluidity modifier, thickner, adhesive, coloring agent and the like.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE 1

100 parts of 3-cyclohexyl-5-(α,α-dimethylbenzyl) salicylic acid was mixed by the use of Nauta mixer (manufactured by HOSOKAWA TEKKOSHO, Japan)

with 500 parts of zinc carbonate and 100 parts of α-methylstyrene-styrene copolymer which was obtained by the polymerization of 60% α-methylstyrene with 40% styrene and had a molecular weight of about 2,000. The water content of the resultant mixture was 1.2%. 250 parts of water containing 5% ethyl alcohol was added in the mixture and the mixture was heated at 150° C. for 15 minutes with stirring. Then the mixture was cooled to a room temperature to form a solid mass. The mass was pulverized by a hammer mill to obtain finely divided particles, 80% of which was passed through 250 mesh Tyler standard screen. The obtained color developer contained 1.5% water on the total dry basis.

EXAMPLE 2

100 parts of 3,5-di(α-methylbenzyl) salicylic acid was mixed by the use of Nauta mixer with 10 parts of zinc oxide, 30 parts of polystyrene having a molecular weight of about 1,500 and 8 parts of water. The resultant mixture was heated and kneaded in an extruder set to 150° C. After cooling the mixture, the obtained mass was pulverized in a grinder to form finely divided particles 90% of which was passed through 300 mesh Tyler standard screen. The obtained color developer contained 1.0% water on the total dry basis.

EXAMPLE 3

Example 2 was repeated except that the extruder was set to 100° C. instead of 150° C. There was obtained finely divided particles of color developer with 3.5% water on the total dry basis. 90% of the particles was passed through 250 mesh Tyler standard screen.

EXAMPLE 4

Example 2 was repeated except that 10 parts of calcium carbonate was used instead of 10 parts of zinc oxide to obtain finely divided particles of color developer with 0.9% water on the total dry basis.

EXAMPLE 5

Example 2 was repeated except that 30 parts of Nikanol-S-100(thermoplastic modified xylene resin with a softening point of 110° C. manufactured by Mitsubishi Gas Chemistry Co., Japan) was used instead of 30 parts of polystyrene to obtain finely divided particles of color developer which contained 1.1% water on the total dry basis.

EXAMPLE 6

20 parts of fine powder of poly(α-methylstyrene) having a molecular weight of about 1,500 and 0.1 parts of sodium alkylbenzenesulfonate were dispersed in 100 parts of an aqueous solution of 8% sodium 3,5-di(α-methylbenzyl) salicylate. Then the pH of the dispersion was adjusted at 4.0 with an aqueous solution of 20% sulfuric acid to precipitate a mixture of 3,5-di(α-methylbenzyl) salicylic acid and poly(α-methylstyrene). 40 parts of zinc oxide and 4 parts of activated clay were added in the dispersion and mixed. The solid material of the dispersion was dehydrated with centrifuge and washed. The obtained powder mixture was heated and kneaded in an extruder set to 150° C. to obtain a mass containing 0.8% water on the total dry basis. The mass was pulverized with a grinder to form finely divided particles of color developer, 90% of which was passed through 300 mesh Tyler standard screen.

EXAMPLE 7

100 parts of 3,5-di(α,α-dimethylbenzyl) salicylic acid was mixed by the use of Nauta mixer with 30 parts of magnesium oxide, 30 parts of polystyrene having a molecular weight of about 1,500, 20 parts of a mixture of 70% kaolin and 30% aluminum hydroxide, 2 parts of Demol-N(a formaldehyde-sodium naphthalenesulfonate condensate manufactured by Kao Atlas Co., Japan) and 30 parts of water. The resultant mixture was heated and kneaded in an extruder set to 160° C. The obtained mass was pulverized with a grinder to form finely divided particles of color developer, 90% of which was passed through 300 mesh Tyler standard screen. The color developer contained 0.8% water on the total dry basis.

EXAMPLE 8

100 parts of 3-phenyl-5-(α,α-dimethylbenzyl) salicylic acid was mixed by the use of Nauta mixer with 50 parts of aluminum oxide, 50 parts of styrene-methyl methacrylate copolymer which was obtained by the polymerization of 80% styrene and 20% methyl methacrylate and had a molecular weight of about 2,000 and 20 parts of an aqueous solution of 10% polyvinyl alcohol. The resultant mixture was heated and kneaded in an extruder set to 140° C. to obtain a homogeneous mass. The mass was pulverized with a grinder to form finely divided particles of color developer, 85% of which was passed through 300 mesh Tyler standard screen. The water content of the color developer was 2% on the total dry basis.

EXAMPLE 9

100 parts of 3-(α-methylbenzyl)-5-(α,α-dimethylbenzyl) salicylic acid was mixed by the use of Nauta mixer with 50 parts of zinc oxide and 25 parts of styrene-acrylonitrile copolymer having a molecular weight of about 2,000 which was obtained by the polymerization of 80% styrene and 20% acrylonitrile and 10 parts of an aqueous solution of 10% carboxymethylcellulose. The resultant mixture was heated and kneaded in an extruder set to 160° C. to form a homogeneous mass. The mass was pulverized to obtain finely divided particles of color developer, 90% of which was passed through 300 mesh Tyler standard screen. The water content of the color developer was 0.5% on the total dry basis.

EXAMPLE 10

100 parts of 3-(α-methylbenzyl)-5-ethylsalicylic acid was mixed in a kneader with 80 parts of novolak type p-phenylphenol-formaldehyde polycondensation powder having an average degree of polymerization of about 8, 50 parts of zinc oxide and 20 parts of water. The resultant mixture was heated and kneaded in an extruder set to 150° C. The resinous material obtained from the outlet of the extruder was cooled and pulverized to form finely divided particles of color developer, 90% of which was passed through 300 mesh Tyler standard screen. The water content of the color developer was 3% on the total dry basis.

Control 1.

Example 1 was repeated except that 250 parts of water with 5% ethyl alcohol was not used to prepare a color developer.

Control 2.

Example 2 was repeated except that 4 parts of water was used instead of 8 parts of water to prepare a color developer.

Control 3.

Example 2 was repeated except that 8 parts of water was not used to prepare a color developer.

Control 4.

Example 2 was repeated except that 10 parts of zinc oxide was not used to prepare a color developer.

Control 5.

Example 2 was repeated except that 30 parts of polystyrene was not used to prepare a color developer.

Control 6.

Example 7 was repeated except that 30 parts of water was not used to prepare a color developer.

Control 7.

Example 8 was repeated except that 20 parts of an aqueous solution of 10% polyvinyl alcohol was not used to prepare a color developer.

Control 8.

Example 9 was repeated except that 10 parts of an aqueous solution of 10% carboxymethylcellulose was not used to prepare a color developer.

The properties of the color developers obtained in Examples and Controls were tested with the following methods:

1. Determination of color forming ability.

The color developer containing 10 parts of aromatic carboxylic acid was withdrawn from each color developer obtained in Examples and Controls and mixed with the three- one ratio mixture of aluminum hydroxide and kaolin to make the total amount up to 100 parts. The resultant mixture was further mixed with 0.3 parts of sodium hexametaphosphate, 10 parts of an aqueous solution of 10% polyvinyl alcohol (PVA-217 manufactured by Kuraray Co., Ltd., Japan) and 300 parts of water. Then the mixture was dispersed uniformly with a sand mill. The obtained dispersion was added with 60 parts of an aqueous solution of 10% oxidized starch and 30 parts of 50% carboxylated styrene-butadiene copolymer latex to prepare a color developer composition. The coating composition was coated on one surface of a base paper of 40g/m$^2$ in the weight of an amount of 5g/m$^2$ on dry basis and dried to obtaine a color developer.

On the other, 3 parts of Crystal Violet Lactone and 2 parts of benzoyl leuco-methylene blue were dissolved in 100 parts of alkylnaphthalene. The obtained oily solution was dispersed in 316 parts of an aqueous solution of 6% gelatin to form an emulsion having oil droplets with an average particle size of 4.8 microns.

190 parts of an aqueous solution of 10% gum arabic and 106 parts of water were added to the above emulsion. Thereafter the pH of the emulsion was adjusted to 4.2 by the addition of acetic acid. The resultant system was cooled to 10° C. and added with 13 parts of 10% formaldehyde solution. Then the pH of the system was adjusted to 10.2 by the addition of 5% sodium hydroxide solution. The system was added and mixed with 50 parts of an aqueous solution of 20% oxidized starch and 15 parts of cellulose powder to prepare a microcapsules-containing coating composition. The microcapsules-containing coating composition was coated on one surface of a base paper of 40g/m$^2$ in the weight of an amount of 5g/m$^2$ on dry basis.

A sheet of paper coated with microcapsules were superposed on a sheet of color developer paper coated with the color developer so that the coated surfaces of the papers contacted each other. A metal plate having a contact surface area of 0.7cm$^2$ and a weight of 330g was dropped at a height of 35cm onto the superposed paper to give impact pressure thereon. The developed image on the color developer paper after a day's lapse of time, was tested for its color density by a Macbeth densitometer (RD-100R type manufactured by Macbeth Co., USA) in the 610 m$\mu$ wavelength.

2. Test of the mechanical stability of coating composition.

20 parts of the color developer obtained in Examples and Controls were mixed with 60 parts of aluminum hydroxide powder, 20 parts of kaolin, 0.3 parts of sodium hexametaphosphate, 10 parts of an aqueous solution of 10% polyvinyl alcohol (PVA-217 manufactured by Kuraray Co., Ltd., Japan) and 800 parts of water. The resultant mixture was dispersed uniformly with a sand mill. The obtained dispersion was added and mixed with 60 parts of an aqueous solution of 10% oxidized starch and 30 parts of 50% carboxylated styrene-butadiene copolymer latex to obtain a color developer coating composition.

100 grams of the color developer coating composition was treated with MARON tester (manufactured by Shinsei Sangyo Co., Ltd., Japan) for 10 minutes in the condition of pressure of 5kg/cm$^2$ and rotation of 1000r.p.m. The amount of the coagulum grown by the treatment was measured and the coagulation rate was calculated according to the following formula:

$$\text{Coagulation rate} = \frac{\text{the amount of the coagulum}}{\text{the total solid amount of the coating composition}} \times 100$$

The calculated coagulation rate was shown in Table 1. The coating composition having a large value of the coagulation rate is not good in the mechanical stability. If such a coating composition is pumped out with for example gear pump, Warman pump and the like, the grown coagulum tends to clog the pumps.

As shown in Table 1, the color developers obtained in Examples are superior in the color formability and mechanical stability as compered with the color developers prepared without water in Controls.

TABLE 1

| | | Color density | Mechanical stability |
|---|---|---|---|
| Example | 1 | 0.72 | 0.01 |
| | 2 | 0.81 | 0.02 |
| | 3 | 0.75 | 0.11 |
| | 4 | 0.70 | 0.02 |
| | 5 | 0.80 | 0.02 |
| | 6 | 0.64 | less than 0.01 |
| | 7 | 0.27 | 0.09 |
| | 8 | 0.35 | 0.08 |
| | 9 | 0.78 | 0.01 |
| | 10 | 0.79 | 0.13 |
| Control | 1 | 0.33 | 0.01 |
| | 2 | 0.52 | 0.05 |
| | 3 | 0.45 | 0.08 |
| | 4 | 0.15 | 0.30 |
| | 5 | 0.87 | 0.45 |
| | 6 | 0.14 | 0.14 |

TABLE 1-continued

| | Color density | Mechanical stability |
|---|---|---|
| 7 | 0.13 | 0.09 |
| 8 | 0.46 | 0.10 |

What is claimed is:

1. A method for the production of a color developer which comprises the steps of preparing a mixture of at least one aromatic carboxylic acid, at least one water-insoluble organic polymer and at least one oxide or carbonate of polyvalent metal and water and heating said mixture to melt at least one of aromatic carboxylic acid and said polymer and to make said mixture into a homogeneous mass.

2. A method for the production of a color developer as defined in claim 1, wherein said mixture is heated in the presence of more than 4% by weight of water on the total dry basis of said mixture.

3. A method for the production of a color developer as defined in claim 2, wherein said mixture is heated in the presence of within the range of 5 to 40% by weight of water on the total dry basis of said mixture.

4. A method for the production of a color developer as defined in claim 1, wherein the water content of said color developer is less than 2.5% by weight on the total dry basis.

5. A method for the production of a color developer as defined in claim 4, wherein the water content of said color developer is less than 2.0% by weight on the total dry basis.

6. A method for the production of a color developer as defined in claim 1, wherein said mixture comprises one part by dry weight of said aromatic carboxylic acid, 0.05–5 parts by dry weight of said water-insoluble organic polymer and 0.01–50 parts by dry weight of oxide or carbonate of polyvalent metal.

7. A method for the production of a color developer as defined in claim 1, wherein said aromatic carboxylic acid has a hydroxyl group on the benzene ring at the ortho-position to the carboxyl group.

8. A method for the production of a color developer as defined in claim 1, wherein said aromatic carboxylic acid has 17 or more carbon atoms.

9. A method for the production of a color developer as defined in claim 1, wherein the said water-insoluble organic polymer is at least one selected from the group consisting of polystyrene styrene copolymer, α-methylstyrene polymer and α-methylstyrene copolymer.

10. A method for the production of a color developer as defined in claim 1, wherein said polyvalent metal is selected from the group consisting of zinc, magnesium, aluminum and calcium.

11. A method for the production of a color developer which comprises heating a mixture of at least one aromatic carboxylic acid, at least one water insoluble organic polymer and at least one oxide or carbonate of polyvalent metal in the presence of water to melt at least one of aromatic carboxylic acid and said polymer and to make said mixture into a homogeneous mass, and pulverizing said mass to form finely divided particles.

12. A method for the production of a color developer as defined in claim 11, wherein said mixture is heated in the presence of more than 4% by weight of water on the total dry basis of said mixture.

13. A method for the production of a color developer as defined in claim 12, wherein said mixture is heated in the presence of within the range of 5 to 40% by weight of water on the total dry basis of said mixture.

14. A method for the production of a color developer as defined in claim 11, wherein the water content of said color developer is less than 2.5% by weight on the total dry basis.

15. A method for the production of a color developer as defined in claim 14, wherein the water content of said color developer is less than 2.0% by weight on the total dry basis.

16. A method for the production of a color developer as defined in claim 11, wherein said mixture comprises one part by dry weight of said aromatic carboxylic acid, 0.05–5 parts by dry weight of said water-insoluble organic polymer and 0.01–50 parts by dry weight of oxide or carbonate of polyvalent metal.

17. A method for the production of a color developer as defined in claim 11, wherein said aromatic carboxylic acid has a hydroxyl group on the benzene ring at the ortho-position to the carboxyl group.

18. A method for the production of a color developer as defined in claim 11, wherein said aromatic carboxylic acid has 17 or more carbon atoms.

19. A method for the production of a color developer as defined in claim 11, wherein said water-insoluble organic polymer is at least one selected from the group consisting of polystyrene, styrene copolymer, α-methylstyrene polymer and α-methylstyrene copolymer.

20. A method for the production of a color developer as defined in claim 11, wherein said polyvalent metal is selected from the group consisting of zinc, magnesium, aluminum and calcium.

21. A color developer obtained by the process comprising the steps of preparing a mixture of at least one aromatic carboxylic acid, at least one water-insoluble organic polymer and at least one oxide or carbonate of polyvalent metal and water and heating said mixture to melt at least one of aromatic carboxylic acid and said polymer and to make said mixture into a homogeneous mass.

22. A color developer as defined in claim 21, wherein said mixture is heated in the presence of more than 4% by weight of water on the total dry basis of said mixture.

23. A color developer as defined in claim 22, wherein said mixture is heated in the presence of within the range of 5 to 40% by weight of water on the total dry basis of said mixture.

24. A color developer as defined in claim 21, wherein the water content of said color developer is less than 2.5% by weight of the total dry basis.

25. A color developer as defined in claim 24, wherein the water content of said color developer is less than 2.0% by weight on the total dry basis.

26. A color developer as defined in claim 21, wherein said mixture comprises one part by dry weight of said aromatic carboxylic acid, 0.05–5 parts by dry weight of said water-insoluble organic polymer and 0.01–50 parts by dry weight of oxide or carbonate of polyvalent metal.

27. A color developer as defined in claim 21, wherein said aromatic carboxylic acid has a hydroxyl group on the benzene ring at the ortho-position to the carboxyl group.

28. A color developer as defined in claim 21, wherein said aromatic carboxylic acid has 17 or more carbon atoms.

29. A color developer as defined in claim 21, wherein said water-insoluble organic polymer is at least one selected from the group consisting of polystyrene, styrene copolymer, α-methylstyrene polymer and α methylstyrene copolymer.

30. A color developer as defined in claim 21, wherein said polyvalent metal is selected from the group consisting of zinc, magnesium, aluminum and calcium.

31. A color developer obtained by the process comprising of heating a mixture of at least one aromatic carboxylic acid, at least one water-insoluble organic polymer and at least one oxide or carbonate of polyvalent metal in the presence of water to melt at least one of aromatic carboxylic acid and said polymer and to make said mixture into a homogeneous mass and pulverizing said mass to form finely divided particles.

32. A color developer as defined in claim 31, wherein said mixture is heated in the presence of more than 4% by weight of water on the total dry basis of said mixture.

33. A color developer as defined in claim 32, wherein said mixture is heated in the presence of within the range of 5 to 40% by weight of water on the total dry basis of said mixture.

34. A color developer as defined in claim 31, wherein the water content of said color developer is less than 2.5% by weight on the total dry basis.

35. A color developer as defined in claim 34, wherein the water content of said color developer is less than 2.0% by weight on the total dry basis.

36. A color developer as defined in claim 31, wherein said mixture comprises one part by dry weight of said aromatic carboxylic acid, 0.05–5 parts by dry weight of said water-insoluble organic polymer and 0.01–50 parts by dry weight of oxide or carbonate of polyvalent metal.

37. A color developer as defined in claim 31, wherein said aromatic carboxylic acid has a hydroxyl group on the benzene ring at the ortho-position to the carboxyl group.

38. A color developer as defined in claim 31, wherein said aromatic carboxylic acid has 17 or more carbon atoms.

39. A color developer as defined in claim 31, wherein said water-insoluble organic polymer is at least one selected from the group consisting of polystyrene, styrene copolymer, α-methylstyrene polymer and α-methylstyrene copolymer.

40. A color developer as defined in claim 31, wherein said polyvalent metal is selected from the group consisting of zinc, magnesium, aluminum and calcium.

* * * * *